US005089116A

United States Patent [19]

Gleisner et al.

[11] Patent Number: 5,089,116

[45] Date of Patent: Feb. 18, 1992

[54] PROCESS OF FROTH FLOATATION USING A 5-ALKYL, 5-ALKENYL, OR 5-ARYL-1,3,5,-DITHIAZINE AS A COLLECTOR REAGENT

[75] Inventors: Arturo G. Gleisner, Vina del Mar; Juan C. Vega, Santiago, both of Chile

[73] Assignee: Establecimientos Industriales Quimicos Oxiquim S.A., Vina del Mar, Chile

[21] Appl. No.: 635,967

[22] Filed: Dec. 31, 1990

[51] Int. Cl.[5] ..... B03D 1/012; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,723,295 | 8/1929 | Ney | 209/166 |
| 1,801,320 | 4/1931 | Moses | 209/166 |
| 4,196,073 | 4/1980 | Gannon | 209/167 |
| 4,997,550 | 3/1991 | Cobb | 209/166 |

FOREIGN PATENT DOCUMENTS

| | | | |
|---|---|---|---|
| 512794 | 5/1976 | U.S.S.R. | 209/166 |

*Primary Examiner*—Stanley S. Silverman
*Assistant Examiner*—Thomas M. Lithgow
*Attorney, Agent, or Firm*—Mallinckrodt & Mallinckrodt

[57] ABSTRACT

A process for froth flotation for the recovery of sulfide minerals, or sulfidized oxide minerals, from their ores utilizing a 5-Alkyl, 5-Alkenyl, or 5 Aryl-1,3,5,-Dithiazine as a collector reagent, either alone or in combination with other known collector reagents in the froth flotation of an aqueous pulp of such ores.

13 Claims, No Drawings

PROCESS OF FROTH FLOATATION USING A 5-ALKYL, 5-ALKENYL, OR 5-ARYL-1,3,5,-DITHIAZINE AS A COLLECTOR REAGENT

BACKGROUND OF THE INVENTION

1. Field

The invention is a process of froth flotation for recovering sulfide minerals or sulfidized oxide minerals from ores containing same, using collector reagents for concentrating the desired minerals in the froth.

2. State of the Art

Froth flotation is a very old and widely used process for recovering sulfide minerals, or, more recently, oxide minerals that have been specially sulfidized for the purpose, from ore containing such a mineral or a mixture of such minerals, e.g., copper and molybdenite minerals.

Various chemical compounds have been employed as reagents for collection of such a mineral or minerals in the froth of an ore pulp subjected to froth flotation, so as to be recovered in a froth concentrate of the mineral or minerals. Among the chemical compounds widely used as collector reagents are alkyl monothiocarbonates, alkyl dithiocarbonates, alkyl trithiocarbonates, dialkyl dithiocarbamates, alkyl thiocarbamates, alkyldithiocarbamates, dialkylthioureas, dialkyl and diaryl dithiophosphates, dialkyl monothiophosphates, alkyl mercaptans, xanthogen formates, xanthate esters or mercaptobenzothiazoles.

SUMMARY OF THE INVENTION

We have found that 5-Alkyl-1,3,5-dithiazines and 5-Aryl-1,3,5-dithiazines having the formula:

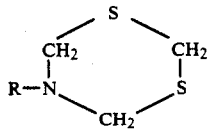

wherein R is an alkyl group containing from one to eight carbon atoms or an aryl (aromatic) group containing six to eight carbon atoms, serve as collectors for sulfide minerals or for sulfidized oxide minerals in the froth flotation of an ore pulp containing such minerals.

These dithiazine [DTA] compounds are known and some have been used heretofore in fields far removed from froth flotation. They exhibit mycobacteriostatic and fungistatic properties. See British Pat. No. 943, 273, Dec. 4, 1963; Chemical Abstracts, 60, 5528a, 1960. They prevent the tarnishing of metals. See, U.S. Pat. No. 2,687,379, Aug. 24, 1954; Chemical Abstracts, 49, 1352b, 1955. However, the use of DTA as a collector reagent in froth flotation has heretofore been unknown.

DETAILED DESCRIPTION OF THE ILLUSTRATED EMBODIMENT

The best mode presently contemplated for carrying out the invention in commercial practice is set forth in the following detailed description of the use of aryl and alkyl DTAs as collector reagents in the froth flotation of a copper ore containing chalcocite (28%), covelin (10%), chalcopyrite (12%), enargite (2%), and pyrite 48%. However, it should be realized that this represents merely a working example of the various possibilities of mineral recovery in accordance with the invention as disclosed generally herein. It is especially noted that the invention may be applied to sulfide minerals, such as those containing copper and molybdenum values, and to oxide minerals that have been specially sulfidized with a sulfidizing agent, such as NaSH.

Any of the DTAs represented by the general formula:

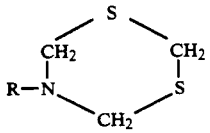

wherein R is an alkyl group containing from one to eight carbon atoms or an alkenyl group containing 2 to 8 carbon atoms or an aryl (aromatic) group containing six to eight carbon atoms, the compound can be employed as a collector reagent in a froth flotation process in accordance with the invention.

In applying the invention to the recovery of sulfide copper values and sulfide molybdenum values from a sulfide ore containing the copper sulfide values as chalcocite and chalcopyrite minerals, and the molybdenum sulfide values as molybdenite from ore containing 1.176% Cu and 0.019% Mo, with an Fe content of 1.756% Fe taken from a mine in Chuquicamata, Chile, the following procedure was used: The ore as ground to 28% less than 65 mesh and formed into a 36% solids flotation pulp by the addition of water, 20 grams per metric ton of the frothing agent known in the industry under the trade name, "DOW-FROTH D-250/MIBC" (methylisobutyl carbinol), the pH of the ore pulp was adjusted to 10.6 with lime and the pulp was conditioned one minute. Collection reagent or reagents were added as indicated below. The resulting flotation pulp was subjected to aeration in a standard flotation cell having a volume of 1.5 liters operated at an impeller speed of 1500 rpm and the flotation time was nine minutes.

The foregoing procedure was repeated on six different batches of 3000 grams of ore using collector reagents of 40 g/ton of the ore, respectively, as follows: 1) sodium-isopropylxanthate [IPX] alone for comparative purposes; 2) 5-ethyl-DTA alone; 3) 80% IPX and 20% 5-ethyl-DTA; 4) 5-isobutyl-DTA; 5) 5-phenyl-DTA; and 6) 50% 5-isobutyl-DTA and 50% 5-phenyl-DTA. The comparative results are shown in the following tables:

TABLE 1

| Flotation Results | IPX Standard | 5-ethyl-DTA | 80% IPX 20% 5-ethyl-DTA |
|---|---|---|---|
| Concentrates | | | |
| % Cu | 10.540 | 11.300 | 11.600 |
| % Mo | 0.130 | 0.160 | 0.180 |
| % Fe | 12.500 | 10.900 | 12.253 |
| Tailings | | | |
| % Cu | 0.220 | 0.200 | 0.170 |
| % Mo | 0.008 | 0.007 | 0.007 |
| % Fe | 0.660 | 0.860 | 0.820 |
| Recovery | | | |
| % Cu | 82.78 | 84.38 | 86.05 |
| % Mo | 63.09 | 68.64 | 69.62 |
| % Fe | 66.15 | 57.06 | 60.34 |

TABLE 2

| Flotation Results | 5-isobutyl DTA | 5-phenyl DTA | 50% 5-isobutyl-DTA 50% 5-phenyl-DTA |
|---|---|---|---|
| Concentrates | | | |
| % Cu | 11.310 | 11.090 | 11.250 |
| % Mo | 0.160 | 0.155 | 0.160 |
| % Fe | 10.950 | 11.000 | 11.000 |
| Tailings | | | |
| % Cu | 0.200 | 0.210 | 0.200 |
| % Mo | 0.007 | 0.007 | 0.006 |
| % Fe | 0.840 | 0.840 | 0.830 |
| Recovery | | | |
| % Cu | 84.40 | 84.10 | 84.20 |
| % Mo | 68.50 | 68.35 | 68.50 |
| % Fe | 57.60 | 57.32 | 57.57 |

It can be seen that, in accordance with the invention, there was an increase in both copper and molybdenum recovery over standard practice with corresponding decrease in copper and molybdenum lost in the tailings.

The examples show that the DTA collectors can be used in combination with xanthates and in combinations of both the alkyl and aryl DTAs to obtain high yields. Other collectors that may be used with DTAs include alkyl monothiocarbonates, alkyl dithio-carbonates, alkyl trithiocarbonates, dialkyl dithiocarbamates, alkyl thiocarbamates, alkyldithiocarbamates, dialkylthioureas, dialkyl and diaryl dithiophosphates, dialkyl monothio-phosphates, alkyl mercaptans, xanthogen formates, xanthate esters and mercaptobenzothiazoles.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A process of froth flotation for the recovery of a sulfide mineral or a sulfidized oxide mineral from an ore, comprising subjecting said ore in the form of an aqueous pulp to froth flotation in the presence of a sufficient amount of a 5-substituted-dithiazine, wherein the substitution is selected from the group consisting of an alkyl of one to eight carbon atoms; an alkenyl of 2 to 8 carbon atoms; and an aryl substituent of six to eight carbon atoms, to act as a collector reagent for said sulfide mineral or sulfidized oxide mineral; and recovering the resulting froth as a concentrate of the desired minerals.

2. A process according to claim 1, wherein the dithiazine collector reagent is 5-isobutyl-dithiazine.

3. A process according to claim 1, wherein the dithiazine collector reagent is 5-ethyl-dithiazine.

4. A process according to claim 2, wherein there is one or more other collector reagents also present in the froth flotation pulp during the froth flotation thereof.

5. A process according to claim 1, wherein there is at least one other collector reagent also present during the froth flotation of the aqueous pulp.

6. A process according to claim 5, wherein the at least one other collector reagent present during the froth flotation of the aqueous pulp is selected from the group of collector reagents consisting of alkyl monothiocarbonates, alkyl dithiocarbonates, alkyl trithiocarbonates, dialkyl dithiocarbamates, alkyl thio-carbamates, alkyldithiocarbamates, dialkylthioureas, dialkyl and diaryl dithiophosphates, dialkyl monothiophosphates, alkyl mercaptans, xanthogen formates, xanthate esters, and mercapto-benzothiazoles.

7. A process of froth flotation according to claim 1, wherein the ore treated by froth flotation contains one or more sulfide mineral of copper, molybdenum, zinc, iron or nickel, or contains one or more sulfidized oxide mineral of said metals, and wherein one or more of said sulfide minerals or sulfidized oxide minerals are recovered.

8. A process of froth flotation according to claim 7, wherein the sulfide mineral is chalcocite, coveline, chalcopyrite, enargite, or pyrite, or a combination of same.

9. A process of froth flotation for the recovery of one or more sulfide minerals or sulfidized oxide minerals from an ore, comprising subjecting said ore in the form of an aqueous pulp to froth flotation in the presence of one or more dithiazines represented by the formula:

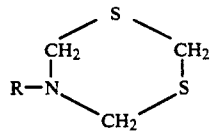

wherein R is either: a) an alkyl group of one to eight carbon atoms; b) an alkenyl group of 2 to 8 carbon atoms; and c) an aryl group of six to eight carbon atoms; and recovering the resulting froth as a concentrate of the desired minerals.

10. A process according to claim 9, wherein there is one or more other collector reagents also present during the froth flotation of the aqueous pulp.

11. A process according to claim 10, wherein the one or more other collector reagents also present during the froth flotation of the aqueous pulp is an alkyl mono-thiocarbonate, an alkyl dithiocarbonate, an alkyl trithiocarbonate, a dialkyl dithiocarbamate, an alkyl thiocarbamate, an alkyldithiocarbamate, a dialkylthiourea, a dialkyl and diaryl dithiophosphate, a dialkyl monothiophosphate, an alkyl mercaptan, a xanthogen formate, a xanthate ester or a mercaptobenzothiazole.

12. A process of froth flotation according to claim 9, wherein the one or more sulfide mineral or sulfidized oxide mineral basis in the ore is copper, molybdenum, zinc, iron, or nickel sulfide or sulfidized oxide.

13. A process of froth flotation according to claim 12, wherein the one or more sulfide mineral is chalcocite, coveline, chalcopyrite, enargite, or pyrite, or a combination of two or more of these.

* * * * *